US005518075A

United States Patent [19]

Williams

[11] Patent Number: 5,518,075

[45] Date of Patent: May 21, 1996

[54] FIRE EXTINGUISHER

[76] Inventor: Robert A. Williams, 2721 White Settlement Rd., Fort Worth, Tex. 76107

[21] Appl. No.: 184,280

[22] Filed: Jan. 21, 1994

[51] Int. Cl.[6] ..... A62C 37/12

[52] U.S. Cl. ..... 169/59; 169/28; 169/65

[58] Field of Search ..... 169/28, 36, 59, 169/65

[56] References Cited

U.S. PATENT DOCUMENTS

| | | | |
|---|---|---|---|
| 2,417,082 | 3/1947 | Mapes et al. | 169/28 |
| 3,552,495 | 1/1971 | Fiero | 169/28 |
| 3,833,063 | 9/1974 | Williams | 169/28 |
| 3,874,458 | 4/1975 | Williams | 169/28 |
| 3,884,306 | 5/1975 | Williams | 169/28 |
| 3,884,307 | 5/1975 | Williams | 169/28 |
| 3,897,828 | 8/1975 | Glover | 169/65 |
| 4,813,487 | 3/1989 | Mikulee et al. | 169/65 |

*Primary Examiner*—Stephen Avila
*Attorney, Agent, or Firm*—Arthur F. Zobal

[57] ABSTRACT

The fire extinguisher particularly useful on a cooking stove, is formed by a container having a fire extinguishing powder, an explosive charge and a heat sensitive fuse. The fuse actuator the charge for forming an opening in the container through which the powder passes. A screen is located across the opening formed to meter the flow of fire extinguishing powder. A vent is provided to release the pressure in the container resulting form actuation of the explosive charge. A tiltable hanging assembly is provided as well as an extension fuse. For use on a gas stove, a system including an acoustic detector and circuity is provided for turning off the gas upon detection of the sound produced upon actuation of the explosive charge.

35 Claims, 6 Drawing Sheets

FIRE EXTINGUISHER

BACKGROUND OF THE INVENTION

1. Field of the Invention

The invention relates to a fire extinguisher employing an explosive charge for releasing fire extinguishing substance from a container.

2. Description of the Prior Art

U.S. Pat. Nos. 3,833,063; 3,874,458; 3,884,306; and 3,884,307 disclose prior art fire extinguishers.

SUMMARY OF THE INVENTION

It is an object of the invention to provide an improved fire extinguisher of the type comprising a closed container, a fire extinguisher substance located in the container, an explosive means located in close proximity to a given portion of the wall of the container for forming an opening through the wall when actuated, and a heat sensitive means for actuating the explosive means to form the opening to allow the fire extinguishing substance to pass out of the opening.

In one embodiment, a screen is located across the opening formed to meter the fire extinguishing substance as it passes through the opening.

In another embodiment, a vent is provided at a position spaced away from said given portion of the wall to vent to the atmosphere, high pressure in the container resulting from excessive heat and gases which may occur in the container before actuation of the explosive means.

In a further embodiment, said given portion of said wall comprises a web with weakened portions selectively formed to facilitate rupture to form a plurality of said openings upon actuation of said explosive means. The web is strengthened to prevent the web from being forced outward due to high pressure in the container.

The fire extinguisher is particularly adapted for use with a stove. The heat sensitive means comprises a main fuse extending through the wall of the container to the explosive and having an end extending outward beyond the wall of the container. An extension fuse is provided for attachment to the main fuse if needed in order to locate the fuse closer to the heaters of the stove.

In a further aspect, coupling means comprising a magnet is connected to the upper end of the container for attachment to the vent of the stove to allow the lower end of the container with the fuse to hang downward over the stove. A special mechanism is provided to allow the magnet to tilt relative to the container to allow the magnet to be attached to a slanted surface with the container hanging downward.

For use on gas stoves, a system including an acoustic detector and circuitry is provided for turning off the gas upon detection of the sound produced upon actuation of the explosive means.

DESCRIPTION OF THE PREFERRED EMBODIMENTS

Figure 1:
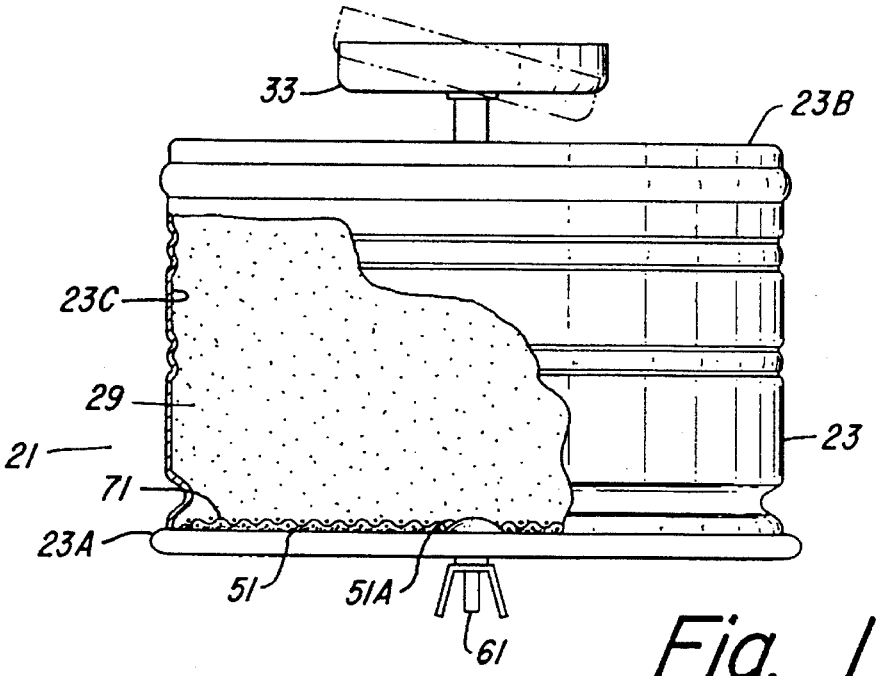
FIG. 1 is a partial cross-sectional view of one embodiment of the fire extinguisher of the invention.

Referring now to FIGS. 1–5, the fire extinguisher illustrated therein is identified by reference numeral 21 and comprises a metal container 23 or can formed by a cup-shaped member having a lower lid 27 sealed to the lower end 23A of the member 23 by a double seam forming a cavity 23C. Located within the container is a fire extinguishing substance 29, preferably a fire extinguishing powder which may be of the A.B.C. type or for example, of the B.C. type. As is well know, the A.B.C. type is formed of about 90% monoammonium phosphate with above 10 percent silicones and other material (silcia, ground mica) added to keep it free flowing to protect it from moisture. The B.C. type is about 90–94 percent sodium bicarbonate. The balance of the material is stearates or silicones and other materials added to keep it free flowing and to protect the sodium bicarbonate from moisture. The top 23B of the container 23 has a magnet 31 attached thereto to allow the fire extinguisher to be attached to a metallic object and hang with its bottom end 27 downward. The fire extinguisher can be attached to the top of a vent-a-hood of a stove for protection against grease fires. The magnet 31 is encased in a case 33 which is moveably attached to the container by an assembly to be described subsequently.

Figure 2:
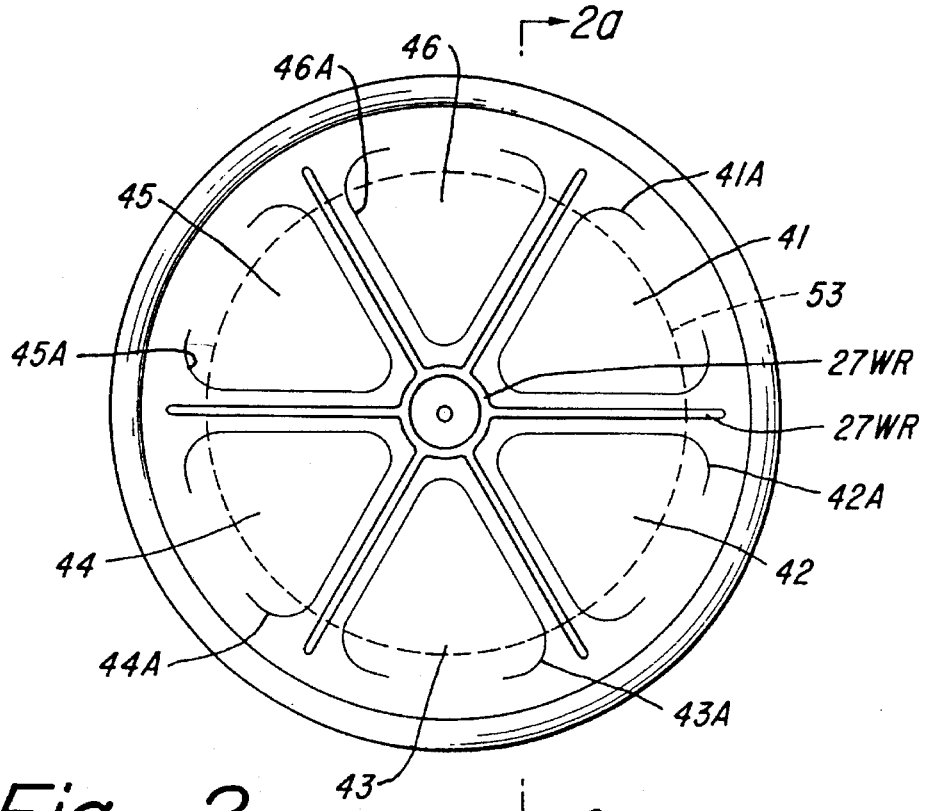
FIG. 2 is a plan view of the bottom of the fire extinguisher illustrating scored lines on its bottom end.
Figure 2A:
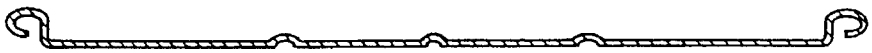
FIG. 2A is a cross section of FIG. 2 taken along the lines 2A—2A.
Figure 3:
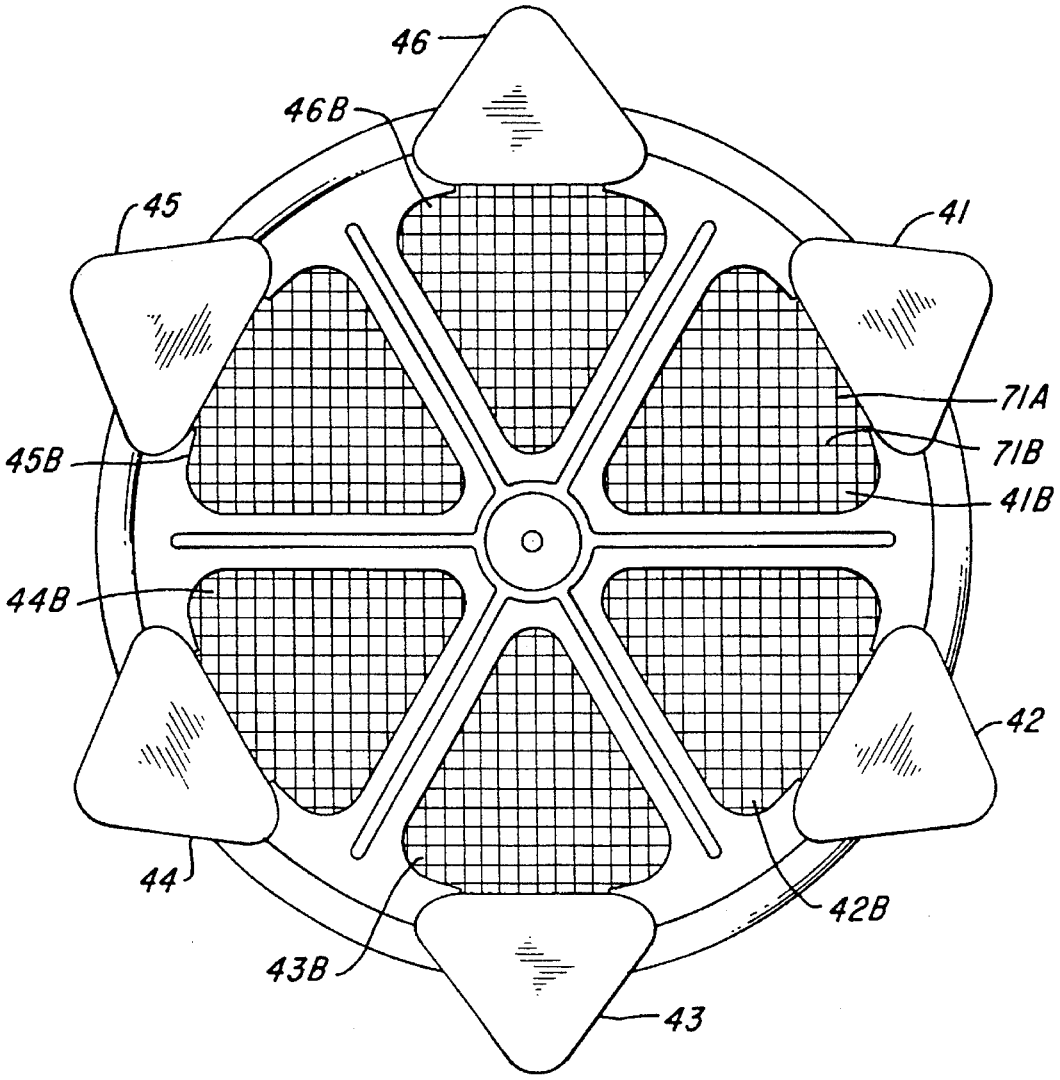
FIG. 3 is a plan view of the bottom of the fire extinguisher after its explosive charge has been ignited and its segments forced outward to form openings through the bottom end to allow its fire extinguishing powder to fall out by way of the screen and openings.

Referring to FIG. 2, the bottom lid 27 has grooves or scored lines 41A–46A selectively formed on the outside thereof to facilitate breaking or rupturing of the bottom end into separate tear-open segments 41–46 without fragmentation to forte openings 41B–46B only in the bottom end or bottom wall portion when the free ends of the segments are forced outward to allow the fire extinguishing powder to fall or pass outward from the container onto the fire. Although the scoring is illustrated on the outside surface of the lid it can be on the inside surface thereof.

The explosive charge for rupturing the bottom end along the weakened or scored lines for forcing the free ends of the segments outward comprises a small amount of explosive charge 51 deposited on the inside of the lid 27. The charge 51 is deposited as a thin layer in the area defined by the dotted circle 53 as seen in FIG. 2. Extending through the lid 27 and to the explosive layer 51 is a heat sensitive fuse or firetrain 61. On the inside, the fuse is held in contact with the explosive 51 by means 51A. The fuse 61 may be held in place by a ferrule and a push on friction nut as shown in U.S. Pat. No. 3,884,307. The fuse 61 ignites when the temperature outside of the fire extinguisher reaches a certain level to explode the charge 51. When this occurs, the force of the explosion ruptures the scored or weakened lines and forces the tear open segments 41–46 outward to form the openings 41B–46B. In addition, the force of the charge pushes the fire extinguishing powder upward in the container, loosening any caking. The fire extinguishing powder then falls out of the can by gravitational force to extinguish any fire below which may be in a frying pan, for example. The explosive charge 51 and fuse 61 may be of the type disclosed in U.S. Pat. No. 3,884,307 which patent is herein incorporated by reference. Although the fire extinguisher of this patent is effective, some problems have occurred in that the fire extinguishing powder sometimes drops down in a manner which causes splashing of the grease. In addition the pressure in the container resulting from excessive heat before activation of the explosive may cause the container to "puff up" which affects formation of the openings 41B–46B.

In accordance with one aspect of the invention, there is provided a metal metering screen 71 formed of members 71A and 71B which is located in the container and secured to the inside of the lid 27 over the explosive 51. The screen 71 has a central opening to receive the means 51A. The screen is round and extends outward beyond the explosive where its outer edge 73 is secured to the inside of the lid 27 between the edges 23E and 27E of the can and lid when they are bent together to form the seam. When the openings 41B–46B are formed, the non-erupting portions or web 27W of the lid 27 hold the central portion of the screen 71 in place. The screen 71 meters the flow of powder through the openings 41B–46B and causes it to fall down in an even distribution and prevents splashing of the grease which may be in a pan below the fire extinguisher. The screen 71 can be a ⅛ inch, ¼ inch, 3/8 or ½ inch mesh size screen.

Tests were conducted with and without the screen 71 using a container having a diameter of about 3 3/8 inches and height of about 2 inches and wherein six openings 41A–46B in the lid 27 were formed with the lid 27 located 32 inches above a flat surface onto which the powder was dropped.

Without the screen 71, the container was emptied in 5 seconds depositing about 75% of the powder in a 10 inch diameter circle. Using a ½ inch mesh screen 71, the container was emptied in 6 seconds with 75% of the powder deposited on the lower surface in a 10 inch diameter circle. Using a ¼ inch mesh screen 71, the container was emptied in about 7 second with 75% of the powder deposited in a 8 inch diameter circle on the lower surface. With a ⅛ inch mesh screen, the container was emptied in about 16 seconds with 75% of the powder deposited in a 10 inch circle. These test showed that the screen allowed the powder to flow out of the container sufficiently fast with an even distribution on the surface below to minimize any splashing of grease in a pan located on a burner of the stove below. The screen 71 also allows use of the deeper container 23 which holds more fire extinguishing powder 29. For the container size described above, a 3/8 inch mesh size screen is preferred.

Figure 4:
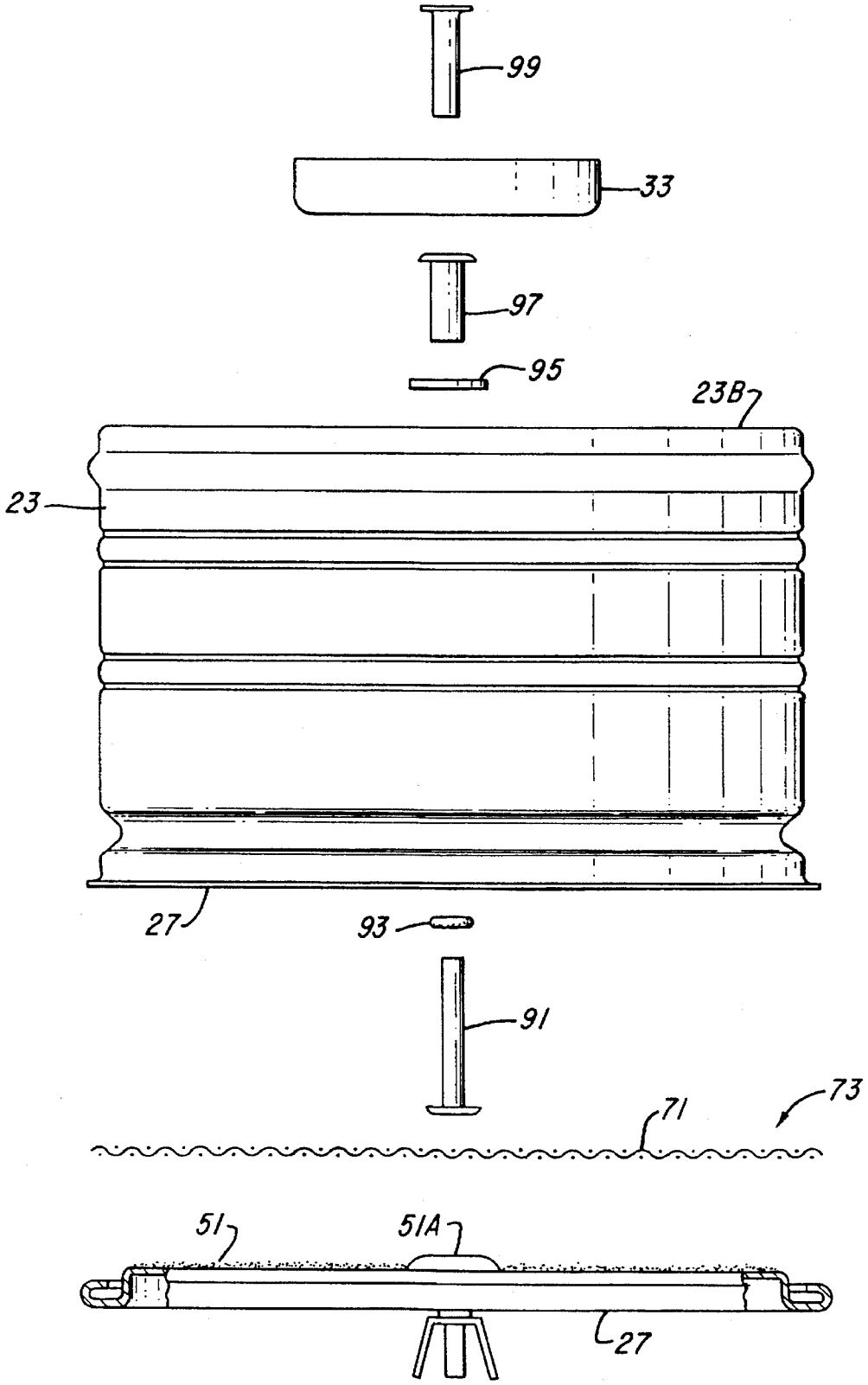
FIG. 4 is an exploded view of the fire extinguisher components.
Figure 5:
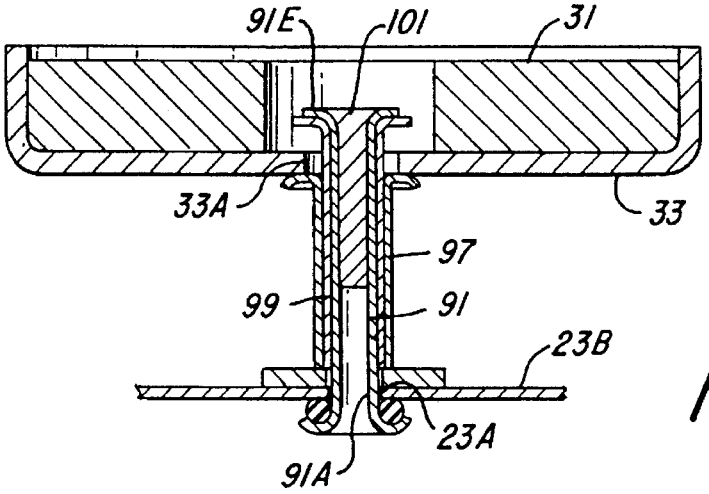
FIG. 5 is a partial cross-sectional side view of the fire extinguisher showing its coupling magnet and one embodiment of a vent.

Referring to FIGS. 4 and 5, the assembly for connecting the magnet 31 and case 33 to the top 23B of the container 23 comprises a hollow eyelet 91, a resilient O-ring 93, a washer 95, a hollow eyelet 97 and a hollow eyelet 99. The top 23B of the container 23 has a central aperture 23BA formed therethrough and the case 33 has a central aperture 33A formed therethrough. The eyelet 91 is inserted through the O-ring 93, and through the aperture 23BA. The eyelet 97 is located around the eyelet 91. The case 33 has a central aperture 33A formed therethrough. The eyelet 99 is inserted through the aperture 33A, around the eyelet 91 and into the eyelet 97. The edge 91E of the eyelet 91 crimped over to secure the assembly together. The eyelet 99 is longer than the eyelet 97 and the space between the rims 97R and 99R of the eyelets 97 and 99 allows the case 33 to tilt relative to the wall 23B of the can 23. This allows the magnet 31 to be attached to a slanted surface of the metal vent-a-hood with the container 23 hanging generally straight down.

The opening 91A extending through the eyelet 91 is filled with a lower temperature melting solder 101 which will melt to provide a vent through the top wall 23B of the container if the inside of the can 23 gets too hot before the explosive 51 is actuated. This relieves the pressure in the container and prevents the container wall from "puffing up" which may occur due to the heat and gases released in the can 23 before the explosive 51 is actuated.

If the can 23 does puff up or swell the web 27W may be pushed outward before the explosive 51 is actuated preventing the vanes or segments 41–46 from opening outward since the resulting openings 41B–46B may be smaller than the segments 41–46.

Figure 6:
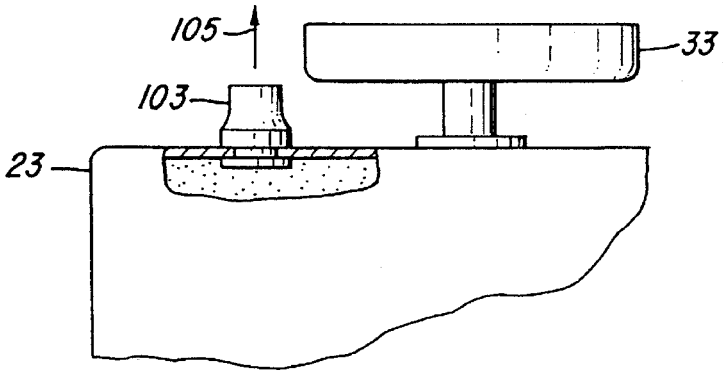
FIG. 6 illustrates another embodiment of a vent.
Figure 7:
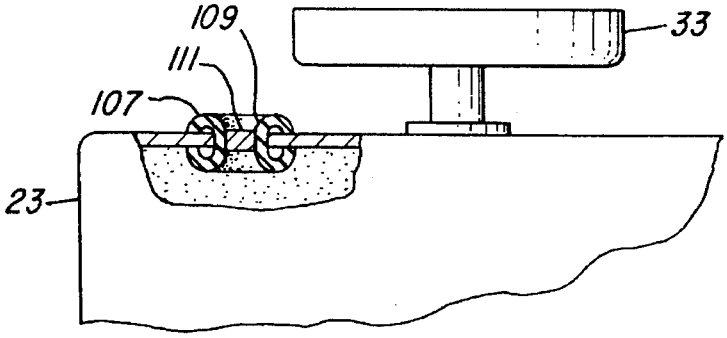
FIG. 7 illustrates a third embodiment of a vent.

FIGS. 6 and 7 show different embodiments of vents which also may be formed through the top wall of the container. In the embodiment of FIG. 6, the vent is a one-way "duckbill" valve 103 allowing flow only in the direction of the arrow 105. In the embodiment of FIG. 7, the vent comprises a hollow vent 107 having its opening 109 filled with wax 111 which melts in the presence of heat allowing pressure release from the container 23.

Embossed reinforcing ribs 27WR also are formed on the web 27W to make the web 27W stiffer which prevents the web from being pushed outward which also minimizes the problem of the segments or vanes not opening outward. The ribs 27WR are formed by bending the web 27W outward after the score lines 41A are formed which tends to pull metal away from the score lines 41A–46A faciliting opening of the segments 41–46.

Figure 9:
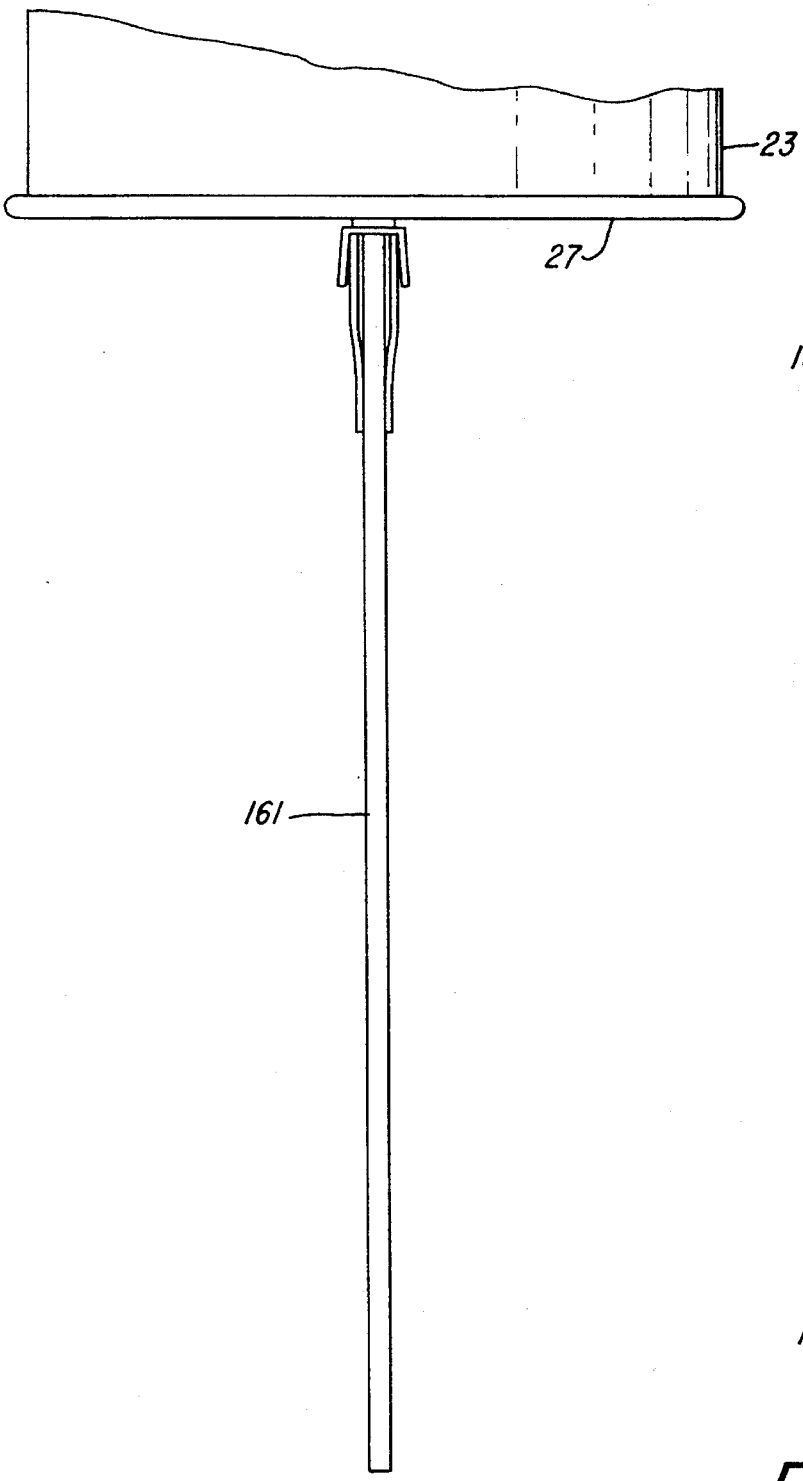
FIG. 9 illustrates the extension fuse attached to the main fuse of the container.
Figure 8:
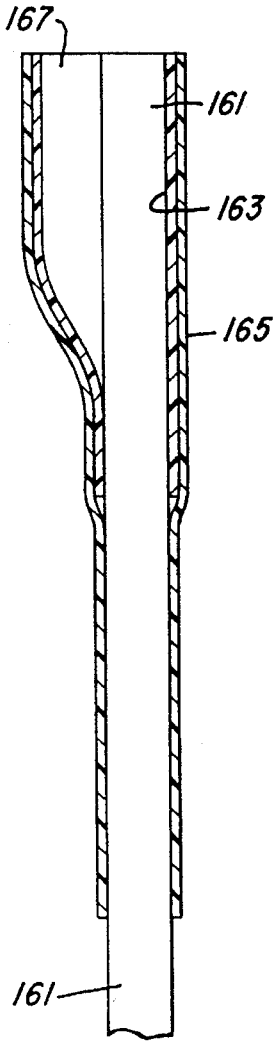
FIG. 8 illustrates the connecting end of an extension fuse.

Referring now to FIGS. 8 and 9, there is shown an extension fuse 161 adapted to be attached to the main fuse 61 if needed The main fuse 61 extends out of the lower lid 27 about ½ of an inch and has a diameter of about 3/32 of an inch. The extension fuse 161 is formed of the same material as fuse 61 and has the same diameter. Its length is about 5½ inches. It has two sleeves 163 and 165 with an opening 167 formed at its end 161U on one side of the fuse 161 between the fuse 161 and the sleeve 163 for receiving the lower end of the fuse 61 and clamping the fuse 161 to the fuse 61. By attaching the fuse 161 to the fuse 61, the effective fuse will be closer to the fire source and will result in the fire extinguisher being actuated sooner than if only the shorter main fuse 61 were used.

Figure 10:
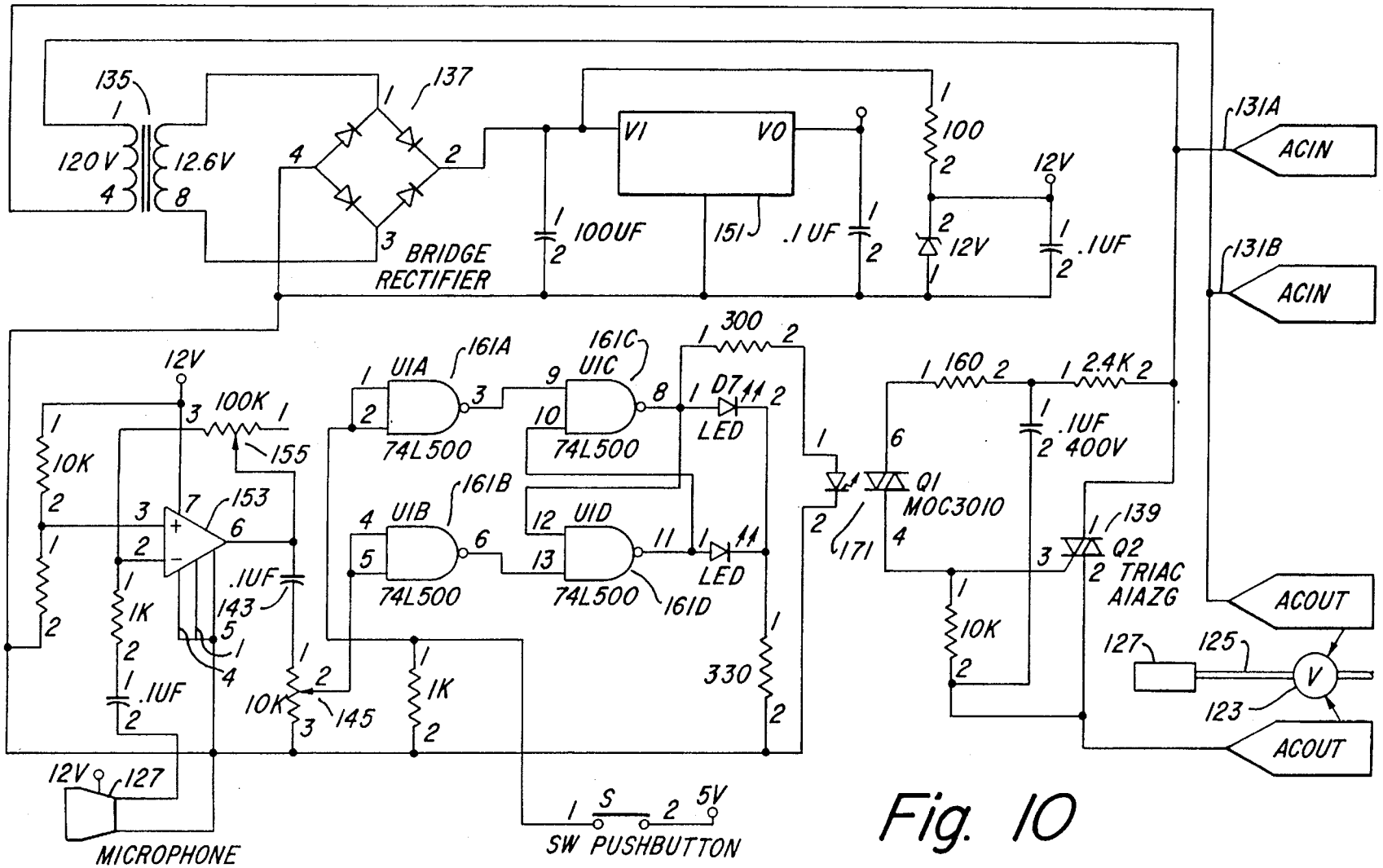
FIG. 10 is an electrical schematic of a system for shutting off a gas stove upon detection of the noise produced by the explosive of the fire extinguisher upon actuation.

Referring to FIG. 10 there is disclosed an acoustic detector 127 and circuitry for closing a solenoid actuated valve 123 in a gas pipe 125 leading to a stove 127, when the detector 121 and circuity detects the sound produced upon actuation of the explosive charge. 120 A.C. voltage is taken from leads 131A and 131B and applied by way of a 12 volt transformer 135 to a full wave rectifier 137 which converts the A.C. to D.C. voltage. The D.C. is applied to operate the detector 127 and a filter comprising a capacitor 143 and a potentiometer 145. The filter is a high pass filter and passes a voltage representative of the sound produced upon explosion of the explosive charge 51 for producing an output for controlling a triac 139 for allowing passage of A.C. to lead 141A for closing the normally open valve 123. The purpose of the filter is to prevent lower frequency background noise from actuating the valve 123.

More details of the circuit of FIG. 10 now will be described. Member 151 is a 5 volt regulator which produces 5 volts at its output for operation some of the circuity. Member 153 is an operational amplifier for amplifying the output of the microphone 127. The gain of the amplifier is controlled by potentiometer 155 and its frequency response is controlled by potentiometer 145. Members 161A, 161B, 161C, and 161E are nand gates of a single chip. Gates 161A and 161B are inverters and gates 161C and 161D form a set-reset flip-flop. Member 171 is an optical coupler. Five volts on its left side as shown, turns on two SCRs which turns on the triac 139 to close the solenoid valve 123. In one embodiment the representative of sound frequencies above about one Khz. and blocks lower frequencies.

The electrical valves and other information of the components of the circuitry are set forth on FIG. 10.

I claim:

1. A fire extinguisher, comprising:

a closed container having a surrounding wall forming a cavity, a fire extinguishing powder located in said cavity of said container, explosive means located in close proximity to a given portion of said container on the inside thereof for forcing said given portion of said wall outward for forming an opening through said wall when actuated, a screen coupled to the inside of said wall of said container across said given portion of said wall, and heat sensitive means for actuating said explosive means in the presence of heat above a given level to form said opening to allow said fire extinguishing powder to pass out of said cavity of said container by way of said screen and said opening.

2. The fire extinguisher of claim 1, wherein:

said closed container has an upper end and a lower end, coupling means coupled to said upper end of said container for use for supporting said container with said lower end facing downward, said given portion of said wall of said container, said explosive means, said screen, and said heat sensitive means are located at said lower end of said container whereby said opening is formed through said wall of said container at said lower end when said explosive means is actuated to allow said fire extinguishing powder to fall through said opening by way of said screen.

3. The fire extinguisher of claim 2, wherein:

said given portion of said wall of said container comprises a web with weakened portions selectively formed to facilitate rupture to form a plurality of said openings upon actuation of said explosive means, said web having embossed portions to strengthen said web to prevent said web from being forced outward due to high pressure in said container.

4. The fire extinguisher of claim 2, wherein:

said heat sensitive means comprises a fuse extending through said said wall of said container at said lower end to said explosive means and having an outer portion extending outward beyond said lower end of said container, and an extension fuse adapted to be coupled to said outer portion of said fuse to provide a lower fuse portion for actuating said explosive means.

5. The fire extinguisher of claim 2, comprising a system for turning off gas to a gas burning stove upon actuation of said explosive means for allowing said fire extinguisher to be used with a gas burning stove comprising:

a normally open electrically actuated valve for controlling gas flow to a stove, and a sound sensing means coupled to said valve for sensing the sound resulting from actuation of said explosive means and closing said valve when said sound is sensed.

6. A fire extinguisher, comprising:

a closed container having a surrounding wall forming a cavity, a fire extinguishing substance located in said cavity of said container, explosive means located in close proximity to a given portion of said container on the inside thereof for forcing said given portion of said wall outward for forming an opening through said wall when a screen coupled to the inside of said wall of said container across said given portion of said wall, heat sensitive means for actuating said explosive means in the presence of heat above a given level to form said opening to allow said fire extinguishing substance to pass out of said cavity of said container by way of said screen and said opening, and at least one vent extending through said wall of said container at a position spaced away from said given portion of said wall for releasing pressure in said container during actuation of said explosive means.

7. The fire extinguisher of claim 6, wherein:

said closed container has an upper end and a lower end, coupling means coupled to said upper end of said container for use for supporting said container with said lower end facing downward, said fire extinguishing substance comprising a fire extinguishing powder, said given portion of said wall of said container, said explosive means, said screen, and said heat sensitive means are located at said lower end of said container whereby said opening is formed through said wall of said container at said lower end when said explosive means is actuated to allow said fire extinguishing powder to fall through said opening by way of said screen, said heat sensitive means comprises a fuse extending through said wall of said container at said lower end to said explosive means and having an outer portion extending outward beyond said lower end of said container, and an extension fuse adapted to be coupled to said outer portion of said fuse to provide a lower fuse portion for actuating said explosive means, said outer portion of said fuse comprises a relatively slender member with a free outer end, said extension fuse has one end with an opening for receiving and attaching to said free outer end of said outer portion of said fuse.

8. The fire extinguisher of claim 6, wherein:

said closed container has an upper end and a lower end, coupling means coupled to said upper end of said container for use for supporting said container with said lower end facing downward, said fire extinguishing substance comprising a fire extinguishing powder, said given portion of said wall of said container, said explosive means, said screen, and said heat sensitive means are located at said lower end of said container whereby said opening is formed through said wall of said container at said lower end when said explosive means is actuated to allow said fire extinguishing powder to fall through said opening by way of said screen, said coupling means comprising:

a magnet secured to said magnet holding member, an aperture formed through the upper end of said container, a first eyelet extending through said aperture of said container with an outer portion extending outward beyond said upper end of said container, a second hollow eyelet located around said outer portion of said first eyelet, and a third hollow eyelet extending through said aperture of said magnet holding member, into said second eyelet and around said outer portion of said first eyelet, said outer portion of said first eyelet having means for holding said third eyelet to said magnet holding member, said second and third eyelets having spaced apart ends with said magnet holding member being located therebetween, said space between said ends of said second and third eyelets being sufficient to allow said magnet holding member and magnet to tilt relative to said container.

9. The fire extinguisher of claim 6, wherein:

said given portion of said wall of said container comprises a web with weakened portions selectively formed to facilitate rupture to form a plurality of said openings upon actuation of said explosive means, said web having embossed portions to strengthen said web to prevent said web from being forced outward due to high pressure in said container.

10. The fire extinguisher of claim 9, wherein:

said given portion of said wall of said container comprises a web with weakened portions selectively formed to facilitate rupture to form a plurality of said openings upon activation of said explosive means, said web having embossed portions to strengthen said web to prevent said web from being forced outward due to high pressure in said container.

11. A fire extinguisher, comprising:

a closed container having a surrounding wall forming a a fire extinguishing powder located in said cavity of said container, explosive means located in close proximity to a given portion of said container on the inside thereof for forcing said given portion of said wall outward for forming an opening through said wall when a screen coupled to the inside of said wall of said container across said given portion of said wall, heat sensitive means for actuating said explosive means in the presence of heat above a given level to form said opening to allow said fire extinguishing powder to pass out of said cavity of said container by way of said screen and said opening, said closed container has an upper end and a lower end, coupling means coupled to said upper end of said container for use for supporting said container with said lower end facing downward, said given portion of said wall of said container, said explosive means, said screen, and said heat sensitive means are located at said lower end of said container whereby said opening is formed through said wall of said container at said lower end when said explosive means is actuated to allow said fire extinguishing powder to fall through said opening by way of said screen, said outer portion of said fuse comprises a relatively slender member with a free outer end, said extension fuse has one end with an opening for receiving and attaching to said free outer end of said outer portion of said fuse.

12. A fire extinguisher, comprising:

a closed container having a surrounding wall forming a cavity, a fire extinguishing powder located in said cavity, of said container, explosive means located in close proximity to a given portion of said container on the inside thereof for forcing said given portion of said wall outward for forming an opening through said wall when actuated, a screen coupled to the inside of said wall of said container across said given portion of said wall, heat sensitive means for actuating said explosive means in the presence of heat above a given level to form said opening to allow said fire extinguishing powder to pass out of said cavity of said container by way of said screen and said opening, said closed container has an upper end and a lower end, coupling means coupled to said upper end of said container for use for supporting said container with said lower end facing downward, said given portion of said wall of said container, said explosive means, said screen, and said heat sensitive means are located at said lower end of said container whereby said opening is formed through said wall of said container at said lower end when said explosive means is actuated to allow said fire extinguishing powder to fall through said opening by way of said screen, said coupling means comprises, a magnet holding member having an aperture formed therethrough, a magnet secured to said magnet holding member, an aperture formed through the upper end of said container, a first eyelet extending through said aperture of said container with an outer portion extending outward beyond said upper end of said container, a second hollow eyelet located around said outer portion of said first eyelet, and a third hollow eyelet extending through said aperture of said magnet holding member, into said second eyelet and around said outer portion of said first eyelet, said outer portion of said first eyelet having means for holding said third eyelet to said magnet holding member, said second and third eyelets having spaced apart ends with said magnet holding member being located therebetween, said space between said ends of said second and third eyelets being sufficient to allow said magnet holding member and magnet to tilt relative to said container.

13. A fire extinguisher, comprising:

a closed container having a surrounding wall forming a cavity, a fire extinguisher substance located in said cavity of said container, explosive means located in close proximity to a given portion of said wall of said container on the inside thereof for forcing said given portion of said wall outward for forming an opening through said wall when actuated, heat sensitive means for actuating said explosive means in the presence of heat above a given level to form said opening to allow said fire extinguishing substance to pass out of said cavity of said container by way of said opening, at least one vent extending through said wall of said container at a position spaced away from said given portion of said wall for releasing pressure in said container.

14. The fire extinguisher of claim 13, wherein:

said closed container has an upper end and a lower end, coupling means coupled to said upper end of said container for use for supporting said container with said lower end facing downward, said fire extinguishing substance comprising a fire extinguishing powder, said given portion of said wall of said container, said explosive means, and said heat sensitive means are located at said lower end of said container whereby said opening is formed through said wall of said container at said lower end when said explosive means is actuated to allow said fire extinguishing powder to fall through said opening by way of said screen, said heat sensitive means comprises a fuse extending through said given portion of said wall to said explosive means and having an outer portion extending outward beyond said lower end of said container, and an extension fuse adapted to be coupled to said outer portion of said fuse to provide a lower fuse portion for actuating said explosive means, said outer portion of said fuse comprises a relatively slender member with a free outer end, said extension fuse has one end with an opening for receiving and attaching to said free outer end of said outer portion of said fuse.

15. The fire extinguisher of claim 13, wherein:

said closed container has an upper end and a lower end, coupling means coupled to said upper end of said container for use for supporting said container with said lower end facing downward, said fire extinguishing substance comprising a fire extinguishing powder, said given portion of said wall of said container, said explosive means, and said heat sensitive means are located at said lower end of said container whereby said opening is formed through said wall of said container at said lower end when said explosive means is actuated to allow said fire extinguishing powder to fall through said opening, said coupling means comprising:

a magnet holding member comprising having an aperture formed therethrough, a magnet secured to said magnet holding member, an aperture formed through the upper end of said container, a first eyelet extending through said aperture of said container with an outer portion extending outward beyond said upper end of said container, a second hollow eyelet located around said outer portion of said first eyelet, and a third hollow eyelet extending through said aperture of said magnet holding member, into said second eyelet and around said outer portion of said first eyelet, said outer portion of said first eyelet having means for holding said third eyelet to said magnet holding member, said second and third eyelets having spaced apart ends with said magnet holding member being located therebetween, said space between said ends of said second and third eyelets being sufficient to allow said magnet holding member and magnet to tilt relative to said container.

16. The fire extinguisher of claim 13, wherein:

said given portion of said wall of said container comprises a web with weakened portions selectively formed to facilitate rupture to form a plurality of said openings upon activation of said explosive means, said web having embossed portions to strengthen said web to prevent said web from being forced outward due to high pressure in said container.

17. The fire extinguisher of claim 16, wherein said coupling means comprises:

a magnet holding member comprising having an aperture formed therethrough, a magnet secured to said magnet holding member, an aperture formed through the upper end of said container, a first eyelet extending through said aperture of said container with an outer portion extending outward beyond said upper end of said container, a second hollow eyelet located around said outer portion of said first eyelet, and a third hollow eyelet extending through said aperture of said magnet holding member, into said second eyelet and around said outer portion of said first eyelet, said outer portion of said first eyelet having means for holding said third eyelet to said magnet holding member, said second and third eyelets having spaced apart ends with said magnet holding member being located therebetween, said space between said ends of said second and third eyelets being sufficient to allow said magnet holding member and magnet to tilt relative to said container.

18. The fire extinguisher of claim 15, wherein:

said given portion of said wall of said container comprises a web with weakened portions selectively formed to facilitate rupture to form a plurality of said openings upon activation of said explosive means, said web having embossed portions to strengthen said web to prevent said web from being forced outward due to high pressure in said container.

19. The fire extinguisher of claim 13, comprising:

a relatively low melting temperature material located in said vent for providing a passage through said wall of said container upon melting of said material due to heat for releasing pressure in said container.

20. A fire extinguisher, comprising:

a closed container having a surrounding wall forming a cavity, a fire extinguishing substance located in said cavity of said container, explosive means located in close proximity to a given portion of said wall of said container on the inside thereof for forcing said given portion of said wall of said wall outward for forming an opening through said wall when actuated, heat sensitive means for actuating said explosive means in the presence of heat above a given level to form said opening to allow said fire extinguishing substance to pass out of said cavity of said container by way of said opening, said closed container has an upper end and a lower end, coupling means coupled to said upper end of said container for use for supporting said container with said lower end facing downward, said fire extinguishing substance comprising a fire extinguishing powder, said given portion of said wall of said container, said explosive means, and said heat sensitive means are located at said lower end of said container whereby said opening is formed through said wall of said container at said lower end when said explosive means is actuated to allow said fire extinguishing powder to fall through said opening, said heat sensitive means comprises a fuse extending through said given portion of said wall to said explosive means and having an outer portion extending outward beyond said lower end of said container, and an extension fuse adapted to be coupled to said outer portion of said fuse to provide a lower fuse portion for actuating said explosive means, said outer portion of said fuse comprises a relatively slender member with a free outer end, said extension fuse has one end with an opening for receiving and attaching to said free outer end of said outer portion of said fuse.

21. The fire extinguisher of claim 20, wherein said coupling means comprises:

a magnet holding member having an aperture formed therethrough, a magnet secured to said magnet holding member, an aperture formed through the upper end of said container, a first eyelet extending through said aperture of said container with an outer portion extending outward beyond said upper end of said container and through said aperture of said magnet holding member, a second hollow eyelet located around said outer portion of said first eyelet, and a third hollow eyelet extending through said aperture of said magnet holding member, into said second eyelet and around said outer portion of said first eyelet, said outer portion of said first eyelet having means for holding said third eyelet to said magnet holding member, said second and third eyelets having spaced apart ends with said magnet holding member being located therebetween, said space between said ends of said second and third eyelets being sufficient to allow said magnet holding member and magnet to tilt relative to said container.

22. The fire extinguisher of claim 21, comprising:

at least one vent extending through said wall of said container at a position spaced away from said given portion for releasing pressure in said container.

23. A fire extinguisher, comprising:

a closed container having a side wall and two end walls forming a cavity, a fire extinguishing powder located in said cavity of said container, one of said end walls having a plurality of spaced apart segments extending outward from a central portion to an outer portion with each segment being formed by a scored line, explosive means located in close proximity to said one end wall of said container on the inside thereof for separating said segments from said one end wall along said scored lines and forcing said plurality of segments outward for forming a plurality of openings through said one end wall, when actuated, heat sensitive means for actuating said explosive means in the presence of heat above a given level to form said plurality of openings to allow said fire extinguishing powder to pass out of said cavity of said container by way of said plurality of openings, said one end wall having a plurality of embossed portions formed in spaced apart lines extending from said central portion to said outer portion with one of each of said embossed portions extending between adjacent segment for strengthening said one end wall between said segments, each embossed portion being raised on one side of said one end wall and indented on the opposite side of said one end wall.

24. The fire extinguisher of claim 23, comprising:

a closed loop embossed portion extending around said central portion of said one end wall in engagement with said plurality of embossed portions at said central portion of said one end wall, said closed loop embossed portion being raised on said one side of said one end wall and indented on said opposite side of said one end wall.

25. The fire extinguisher of claim 23, wherein:

said container has an upper and a lower end with said one end of said one end wall being located at said lower end, and coupling means coupled to said upper end of said container for use for supporting said container with said lower end facing downward.

26. The fire extinguisher of claim 24, wherein:

said container has an upper end and a lower end with said one end of said one end wall being located at said lower end, and coupling means coupled to said upper end of said container for use for supporting said container with said lower end facing downward.

27. The fire extinguisher of claim 23, comprising:

at least one vent extending through the other of said end walls for releasing pressure in said container.

28. The fire extinguisher of claim 21, wherein:

said heat sensitive means comprises a fuse extending through said one end wall to said explosive means and having an outer portion extending beyond said one end wall, an extension fuse adapted to be coupled to said outer portion of said fuse to provide a lower fuse portion for actuating said explosive means, said outer portion of said fuse comprises a relatively slender member with a free outer end, said extension fuse has one end with an opening for receiving and attaching to said free outer end of said outer portion of said fuse.

29. The fire extinguisher of claim 28, comprising:

at least one vent extending through the other of said end walls for releasing pressure in said container.

30. The fire extinguisher of claim 29, comprising:

coupling means coupled to the other said end walls of said container for supporting said container with said one end wall facing downward, said coupling means comprising:

a magnet holding member comprising an aperture formed therethrough, a magnet secured-ed to said magnet holding member, an aperture formed through said other end wall of said container, a first eyelet extending through said aperture of said other end wall with an outer portion extending outward beyond said other end wall and extending through said aperture of said magnet holding member, a second hollow eyelet located around said outer portion of said first eyelet, and a third hollow eyelet extending through said aperture of said magnet holding member, into said second eyelet and around said outer portion of said first eyelet, said outer portion of said first eyelet having means for holding said third eyelet to said magnet holding member, said second and third eyelets having spaced apart ends with said magnet holding member being located therebetween, said space between said ends of said second and third eyelets being sufficient to allow said magnet holding member and magnet to tilt relative to said container.

31. The fire extinguisher of claim 23, comprising:

coupling means coupled to the other said end walls of said container for supporting said container with said one end wall facing downward, said coupling means comprising:

a magnet holding member comprising an aperture formed therethrough, a magnet secured to said magnet holding member, an aperture formed through said other end wall of said container, a first eyelet extending through said aperture of said other end wall with an outer portion extending outward beyond said other end wall and through said aperture of said magnet holding member, a second hollow eyelet located around said outer portion of said first eyelet, and a third hollow eyelet extending through said aperture of said magnet holding member, into said second eyelet and around said outer portion of said first eyelet, said outer portion of said first eyelet having means for holding said third eyelet to said magnet holding member, said second and third eyelets having spaced apart ends with said magnet holding member being located therebetween, said space between said ends of said second and third eyelets being sufficient to allow said magnet holding member and magnet to tilt relative to said container.

32. The fire extinguisher of claim 23, comprising:

a screen coupled to the inside of said one end wall of said container across said segments to allow said fire extinguishing powder to pass out of said cavity of said container by way of said screen and said openings when formed upon actuation of said explosive means.

33. The fire extinguisher of claim 27, comprising:

a relatively low melting temperature material located in said vent for providing a passage through said wall of said container upon melting of said material due to heat for releasing pressure in said container.

34. A fire extinguisher for use with a gas stove for extinguishing an undesired fire and for turning off gas to the stove, comprising:

a closed container having a surrounding wall forming a cavity, said closed container has an upper end and a lower end, coupling means coupled to said upper end of said container for use for supporting said container with said lower end facing downward, a fire extinguishing powder located in said cavity of said container, explosive means located in close proximity to a given portion of said container on the inside thereof for forcing said given portion of said wall outward for forming an opening through said wall when actuated, heat sensitive means for actuating said explosive means in the presence of heat above a given level to form said opening to allow said fire extinguisher substance to pass out of said cavity of said container by way of said opening, said given portion of said wall of said container, said explosive means, and said heat sensitive means are located at said lower end of said container whereby said opening is formed through said wall of said container at said lower end when said explosive means is actuated to allow said fire extinguishing powder to fall through said opening, a normally open electrically actuated valve for controlling gas flow to a stove, and a sound sensing means coupled to said valve for sensing the sound resulting from actuation of said explosive means and for closing said valve when said sound is sensed.

35. A fire extinguisher, comprising:

a closed container having a surrounding wall forming a cavity, a fire extinguishing substance located in said cavity of said container, explosive means located in close proximity to a given portion of said wall of said container on the inside thereof for forcing said given portion of said wall outward for forming an opening through said wall when actuated, heat sensitive means for actuating said explosive means in the presence of heat above a given level to form said opening to allow said fire extinguishing substance to pass out of said cavity to said container by way of said opening, said closed container has an upper end and a lower end, coupling means coupled to said upper end of said container for use for supporting said container with said lower end facing downward, said fire extinguishing substance comprising a fire extinguishing powder, said given portion of said wall of said container, said explosive means, and said heat sensitive means are located at said lower end of said container whereby said opening is formed through said wall of said container at said lower end when said explosive means is actuated to allow said fire extinguishing powder to fall through said opening, said coupling means comprising:

a magnet holding member having an aperture formed therethrough, a magnet secured to said magnet holding member, an aperture formed through the upper end of said container, a first eyelet extending through said aperture of said container with an outer portion extending outward beyond said upper end of said container, a second hollow eyelet located around said outer portion of said first eyelet, and a third hollow eyelet extending through said aperture of said magnet holding member, into said second eyelet and around said outer portion of said first eyelet, said outer portion of said first eyelet having means for holding said third eyelet to said magnet holding member, said second and third eyelets having spaced apart ends with said magnet holding member being located therebetween, said space between said ends of said second and third eyelets being sufficient to allow said magnet holding member and magnet to tilt relative to said container.

* * * * *